US006451078B2

(12) United States Patent
Berfield et al.

(10) Patent No.: US 6,451,078 B2
(45) Date of Patent: Sep. 17, 2002

(54) FITTING FOR VACUUM BAGS

(75) Inventors: Robert C. Berfield, Jersey Shore; Robert Lent Crevling, Williamsport, both of PA (US)

(73) Assignee: Shop-Vac Corporation, Williamsport, PA (US)

( * ) Notice: Subject to any disclaimer, the term of this patent is extended or adjusted under 35 U.S.C. 154(b) by 0 days.

(21) Appl. No.: 09/740,697

(22) Filed: Dec. 19, 2000

Related U.S. Application Data

(63) Continuation-in-part of application No. 09/594,542, filed on Jun. 14, 2000, now abandoned, and a continuation-in-part of application No. 09/348,893, filed on Jul. 7, 1999, now Pat. No. 6,179,889.

(51) Int. Cl.[7] ..... B01D 29/23; B01D 29/27; A47L 9/14

(52) U.S. Cl. ..... 55/374; 055/318; 055/418; 055/DIG. 2; 055/DIG. 3; 015/347; 015/353

(58) Field of Search ..... 55/374, 378, 418, 55/505, DIG. 2, DIG. 3; 15/347, 353

(56) References Cited

U.S. PATENT DOCUMENTS

| | | | | |
|---|---|---|---|---|
| 2,778,447 A | * | 1/1957 | Meyerhoefer | 15/327.1 |
| 2,784,800 A | | 3/1957 | Segesman | |
| 3,142,857 A | | 8/1964 | Fresard et al. | |
| 3,350,857 A | | 11/1967 | Fresco | |
| 3,488,928 A | | 1/1970 | Tarala | |
| 3,597,903 A | | 8/1971 | Schaaf | |
| 3,675,399 A | | 7/1972 | Westergren | |
| 3,812,659 A | | 5/1974 | Westergren et al. | |
| 3,820,310 A | | 6/1974 | Fromknecht et al. | |
| 3,830,043 A | | 8/1974 | Nielsen et al. | |
| 3,870,486 A | | 3/1975 | Eriksson et al. | |
| 3,870,491 A | | 3/1975 | Friesen et al. | |
| 3,909,219 A | | 9/1975 | Fromknecht | |
| 4,297,114 A | | 10/1981 | Hutchins | |
| 4,304,580 A | | 12/1981 | Gehl et al. | |
| 4,381,192 A | | 4/1983 | Grimard | |
| 4,469,498 A | | 9/1984 | Fish | |
| 4,591,369 A | | 5/1986 | Stewart, Sr. et al. | |
| 4,609,387 A | | 9/1986 | Berfield et al. | |
| 4,623,366 A | | 11/1986 | Berfield et al. | |
| 4,699,641 A | | 10/1987 | Barnes, Jr. | |
| 4,738,697 A | | 4/1988 | Westergren | |
| 4,801,376 A | | 1/1989 | Kulitz | |
| 4,877,432 A | | 10/1989 | Lackner | |
| 4,894,881 A | | 1/1990 | Palmer et al. | |
| 5,032,155 A | | 7/1991 | Wiese et al. | |
| 5,057,131 A | | 10/1991 | Lackner et al. | |
| 5,064,455 A | | 11/1991 | Lackner | |
| 5,089,038 A | | 2/1992 | Kopco et al. | |
| 5,092,915 A | | 3/1992 | Lackner | |
| 5,205,014 A | | 4/1993 | Yoo | |
| 5,259,854 A | | 11/1993 | Newman | |
| 5,343,592 A | | 9/1994 | Parise | |
| 5,388,301 A | | 2/1995 | Bosyj et al. | |
| 5,394,587 A | | 3/1995 | Parise | |
| 5,455,983 A | | 10/1995 | Crouser et al. | |
| 5,464,460 A | | 11/1995 | Bosses | |
| 5,544,385 A | * | 8/1996 | Jailor et al. | 15/350 |
| 5,669,949 A | | 9/1997 | Dudrey et al. | |
| 5,733,351 A | | 3/1998 | Hult et al. | |
| 5,792,224 A | | 8/1998 | Fu et al. | |
| 5,855,634 A | | 1/1999 | Berfield | |
| 5,871,567 A | | 2/1999 | Covington et al. | |
| 5,954,863 A | | 9/1999 | Loveless et al. | |

* cited by examiner

*Primary Examiner*—Robert A. Hopkins
(74) *Attorney, Agent, or Firm*—Marshall, Gerstein & Borun.

(57) ABSTRACT

A fitting for a vacuum cleaner is disclosed. The fitting includes a retainer having first and second grooves within which a fitting is adapted to slide. The fitting includes a plate from which a cylinder extends and terminates in a radially inwardly directed deflector. Depending upon the orientation of the fitting within the retainer, the incoming fluid stream is directed in an upward or downward direction to thereby facilitate usage of the fitting with or without a vacuum bag, while at the same time minimizing the potential for splashing and expulsion of liquid drawn into the vacuum cleaner.

27 Claims, 6 Drawing Sheets

FITTING FOR VACUUM BAGS

CROSS REFERENCE TO RELATED APPLICATIONS

This application is a continuation-in-part of U.S. patent application Ser. No. 09/348,893, filed on Jul. 7, 1999 now U.S. Pat. No. 6,179,889, as well as U.S. patent application Ser. No. 09/594,542, filed on Jun. 14, 2000 now abandoned.

FIELD OF THE INVENTION

The invention generally relates to vacuum cleaners and, more particularly, relates to mechanisms for mounting vacuum bags in vacuum cleaners.

BACKGROUND OF THE INVENTION

Many vacuum cleaners employ vacuum bags which receive dry debris gathered by the vacuum. Such bags typically include an inlet aperture about which a collar, typically manufactured from cardboard, is secured. The cardboard collar provides a fitting which facilitates attachment of the bag to the discharge end of the vacuum inlet, inside the collection tank of the vacuum cleaner. Such collars typically frictionally fit about the vacuum inlet of a vacuum cleaner, or are slid into opposing grooves laterally flanking the vacuum inlet. Operation of the motor/impeller unit creates a low pressure area within the collection tank, thereby trapping matter which has entered through the vacuum inlet in the bag.

In certain types of vacuum cleaners, known as wet/dry vacuum cleaners, the debris gathered by the vacuum may be wet and/or dry. In such applications, typical vacuum bags are not operable. Such bags are typically manufactured from a paper, or otherwise porous material, which is not suitable for wet debris. In such situations, a bag is not installed within the vacuum cleaner, but rather the wet debris is drawn into and deposited into a tank of the vacuum cleaner. Such tanks are typically manufactured from plastic. The tank can be filled and, when desired, emptied by a number of mechanisms, some of which include the opening of a valve provided at the base of the tank, removal of a lid and physical tilting of the tank to empty its contents, as well as the use of a pumping unit to expel the gathered liquid.

Given the geometry of such wet/dry vacuum cleaners, it is often desirable to employ a deflector device which directs the incoming fluid stream. In the case of a dry pickup wherein a vacuum bag is employed, the deflector device can be used to direct the fluid stream downwardly into the bag. An example of such a device is disclosed in related U.S. patent application Ser. No. 09/594,542.

While the use of a deflector device is desirable, when such a vacuum cleaner is used for wet pickup, the incoming fluid stream can enter the tank of the vacuum cleaner and be directed downwardly by the deflector with such velocity that it may tend to splash within the tank to a sufficient degree to cause a certain component of the fluid to be expelled from the blow port or other openings of the vacuum cleaner. The avoidance of such expulsion of fluid is desirable, while at the same time enabling a single vacuum hose to be used in conjunction with both the vacuum port and blower port of the vacuum cleaner.

SUMMARY OF THE INVENTION

In accordance with one aspect of the invention, a vacuum cleaner is provided which comprises a tank, a lid, a motor/impeller unit, a vacuum bag retanier, a vacuum bag fitting, a vacuum bag, and a vacuum hose. The thank includes a side wall, closed bottom wall and open top with an inlet being provided in the tank side wall. The lid is removable attached to the tank open top. The motor/impeller units is mounted within the lid. The vacuum bag retainer is mounted to the tank side wall. The lid is removably attached to the tank open top. The motor/impeller units is mounted within lid. The vacuum bag retainer is mounted to the tank sidewall inlet. The vacuum bag fitting is connected to the vacuum bag retainer and includes a deflector. The vaccum bag is attached to the vaccum bag fitting while the hose extends to the tank inlet, vacuum bag retainer, vacuum bag fitting, and vacuum bag.

In accordance with another aspect of the invention, a vacuum bag fitting is provided which comprises a plate, a cylinder and a deflector. The plate includes an aperture, while the cylinder includes an inlet and an outlet. The cylinder extends from the plate with the cylinder inlet being concentric with the plate aperture and a longitudinal axis passing through the cylinder. The deflector extends from the cylinder proximate the cylinder outlet and extends toward the longitudinal axis.

In accordance with another aspect of the invention, a vacuum bag fitting assembly is provided which comprises a vacuum bag retainer and a vacuum bag fitting. The vacuum bag retainer includes a back plate and first and second slots, with an aperture being provided in the back plate and the first and second slots laterally flanking the aperture. The vacuum bag fitting is adapted to connect to a vacuum bag and removably attach to the vacuum bag retainer. The vacuum bag fitting includes a plate having an aperture therein and a cylinder extending away from the plate and circumscribing the aperture. The cylinder terminates in a radially inwardly directed deflector. The plate is adapted to slide within the first and second slots of the vacuum bag retainer.

In accordance with another aspect of the invention, a method of attaching a vacuum bag to a vacuum cleaner is provided which comprises the steps of inserting a vacuum bag fitting into a vacuum bag with the vacuum bag fitting including a plate from which a deflector extends, attaching the vacuum bag fitting to a vacuum bag retainer provided within a tank of the vacuum cleaner, inlets of the vacuum bag, vacuum bag fitting, and vacuum bag retainer being aligned, and pushing a vacuum hose through the inlets of the vacuum bag, vacuum fitting, and vacuum bag retainer.

In accordance with another aspect of the invention, a vacuum cleaner of the type having a tank, a lid, a motor/impeller unit mounted in the lid, an inlet to the tank, and a hose adapted to be used for vacuuming and blowing is provided and includes an improvement comprising a bag mounting structure mounted within the tank proximate the inlet, and a deflector adapted to direct an incoming fluid stream into one of a bag and a tank. The deflector is mounted in the bag mounting structure in a downward direction when the fluid stream is dry, and is mounted in the bag mounting structure in a upward direction when the fluid stream is wet.

These and other aspects and features of the invention will become apparent from the following detailed description when taken in conjunction with the accompanying drawings.

Figure 1:
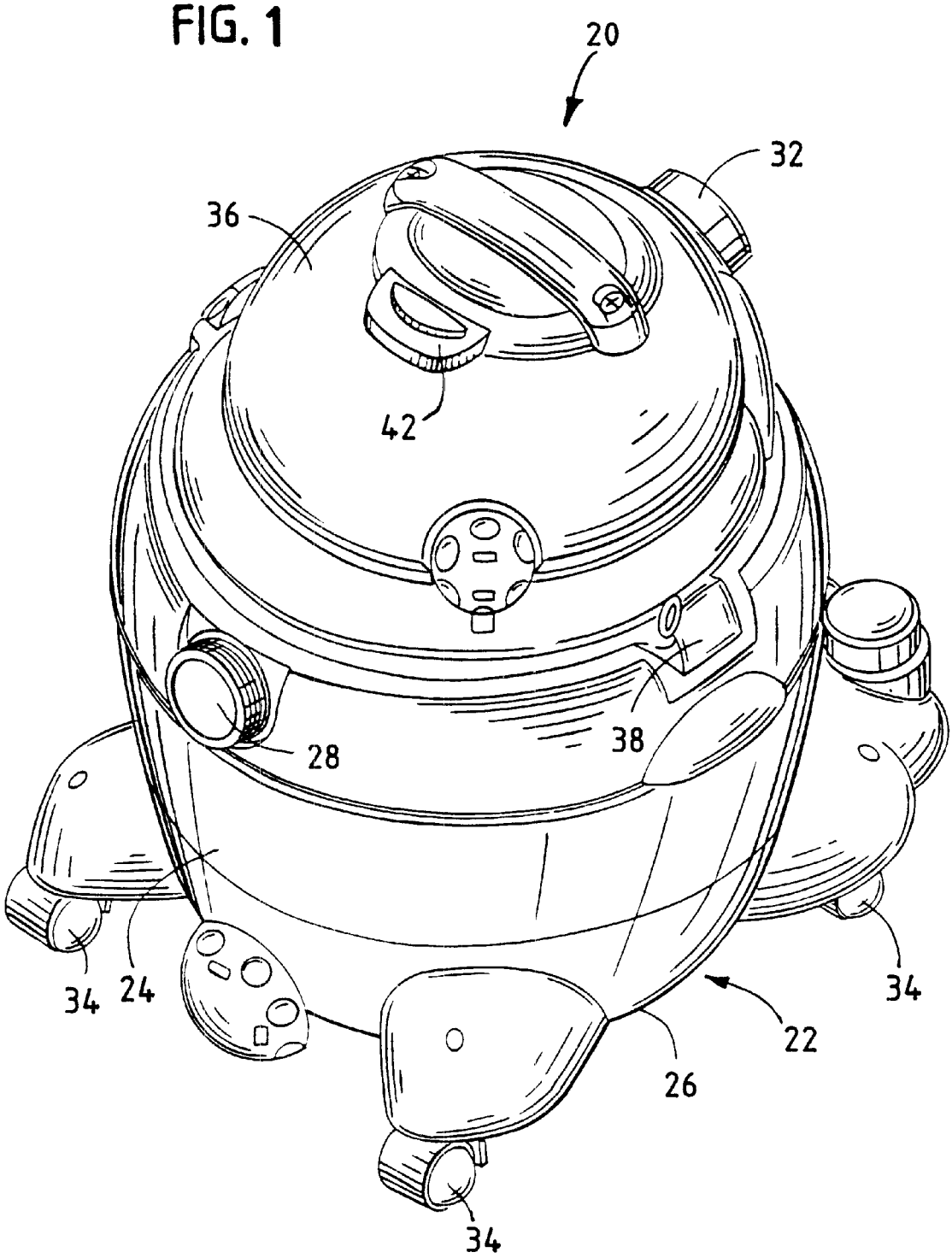
FIG. 1 is an isometric view of a vacuum cleaner constructed in accordance with the teachings of the invention.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Figure 2:
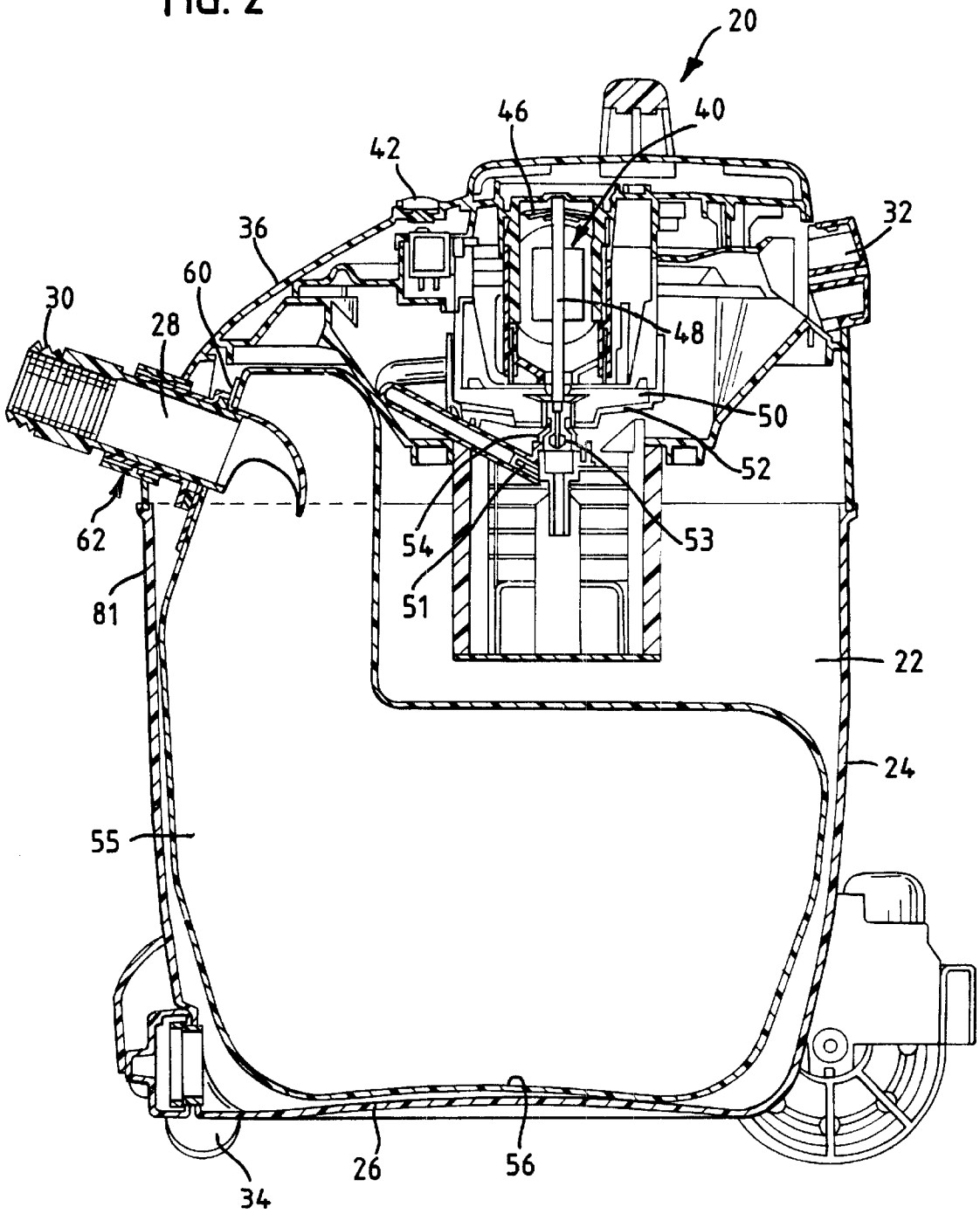
FIG. 2 is a sectional view of FIG. 1 with a vacuum bag installed and a deflector directed downwardly.

Referring now to the drawings, and with specific reference to FIG. 1, a vacuum cleaner constructed in accordance with the teachings of the invention is generally depicted by reference numeral 20. The vacuum cleaner 20 includes a tank 22 having a side wall 24 and a closed bottom 26. The side wall 24 includes an inlet 28 which is adapted to receive a hose 30 (FIG. 2). The hose 30 is also adapted to be received within an outlet 32 to enable the hose 30 to be used in both a vacuuming and blowing capacity. A plurality of casters 34 or other wheels may be attached to the tank 22 to facilitate movement of the vacuum cleaner 20 about a worksite.

The tank 22 is enclosed by a lid 36 which is removable by usage of handles 38. As shown in FIG. 2, the lid 36 houses a motor/impeller unit 40 which can be energized upon actuation of a switch 42. In the depicted embodiment, the tank 22 is generally cylindrical, the lid 36 is correspondingly shaped, and both are manufactured from molded plastic. It is to be understood that the tank 22 and lid 36 can be alternatively shaped and manufactured from other materials and processes.

Referring now to FIG. 2, the vacuum cleaner 20 is shown in sectional view. The motor/impeller unit 40 includes a motor 46 from which a rotatable shaft 48 extends. A vacuum impeller 50 is mounted to the shaft 48 for rotation within a vacuum chamber 52 for generation of a low pressure area within the tank 22 for vacuuming purposes. A pump impeller 53 is also attached to the shaft 48 and rotates within a chamber 54 to draw fluid therein and out through a channel 51 when the vacuum cleaner 20 is used in a pumping capacity.

Figure 6:
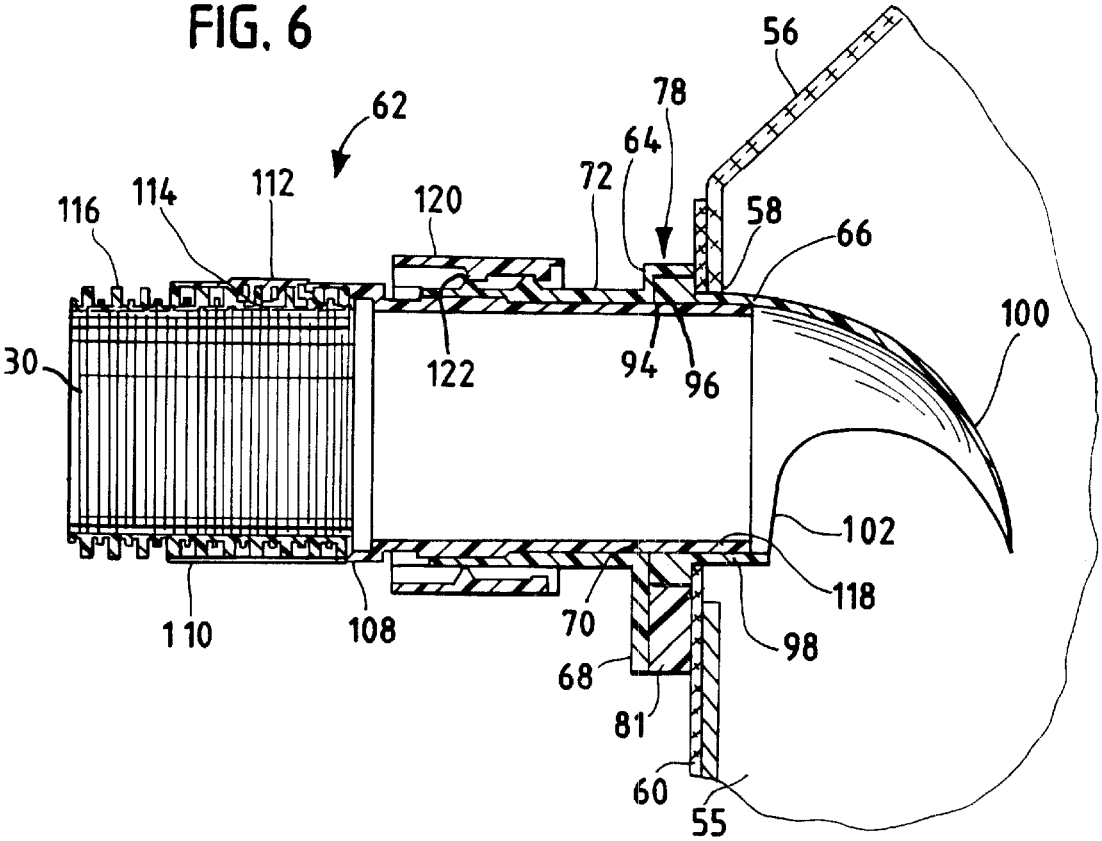
FIG. 6 is a sectional view of FIG. 4 with the deflector directed downwardly.

If the vacuum cleaner 20 is to be used for vacuuming dry material, a vacuum bag 55 may be used as depicted in FIG. 2. As shown therein, the vacuum bag 55 includes an enclosure 56 preferably manufactured from a paper, or otherwise porous material having an inlet aperture 58 (FIG. 6). A collar 60 is provided proximate the aperture 58 to serve as a mounting device for the vacuum bag 55. The collar 60 is preferably manufactured from cardboard but other sufficiently strong material, such as plastic, may be employed.

Figure 3:
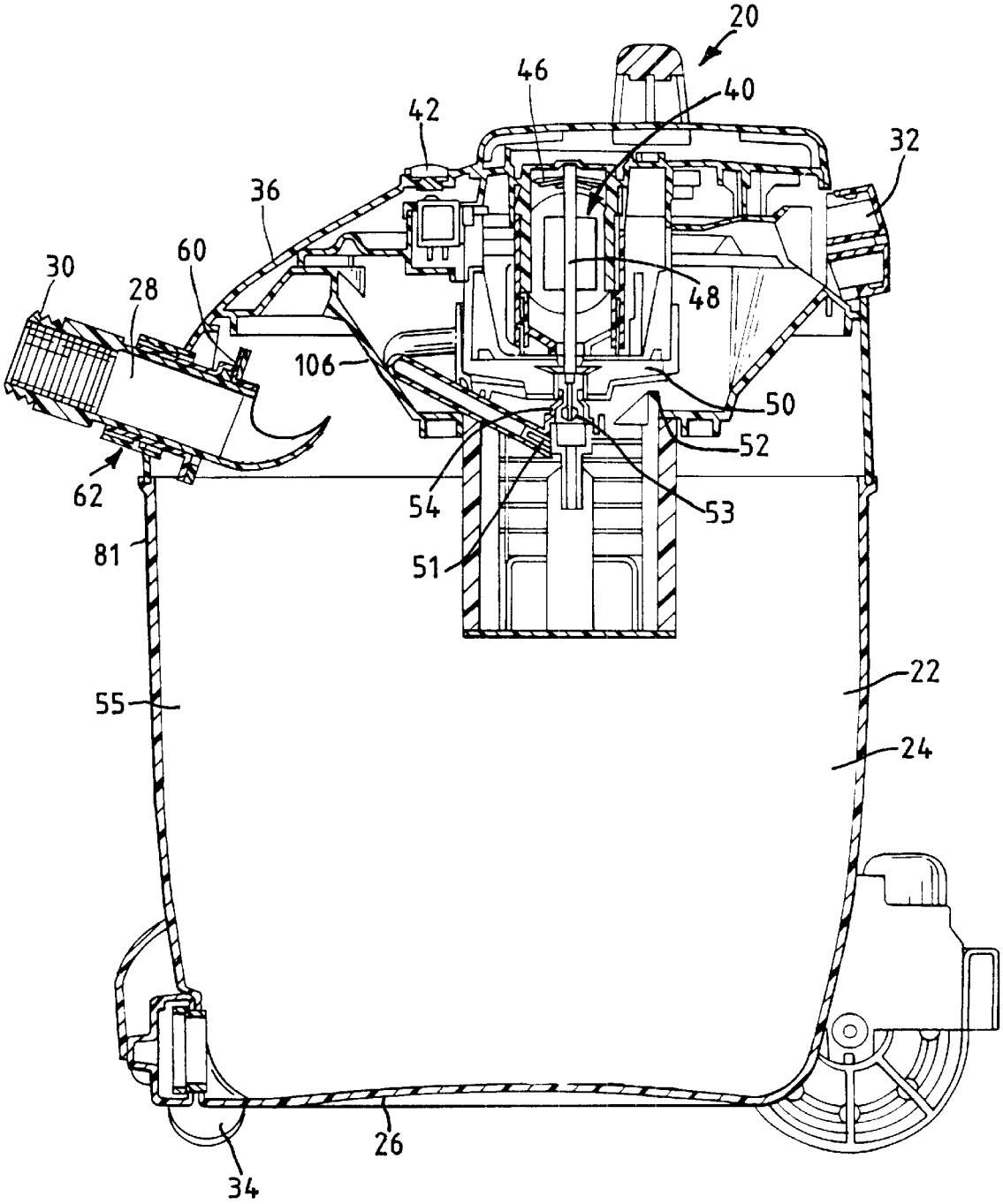
FIG. 3 is a sectional view of FIG. 1 without a vacuum bag installed and with a deflector directed upwardly.
Figure 4:
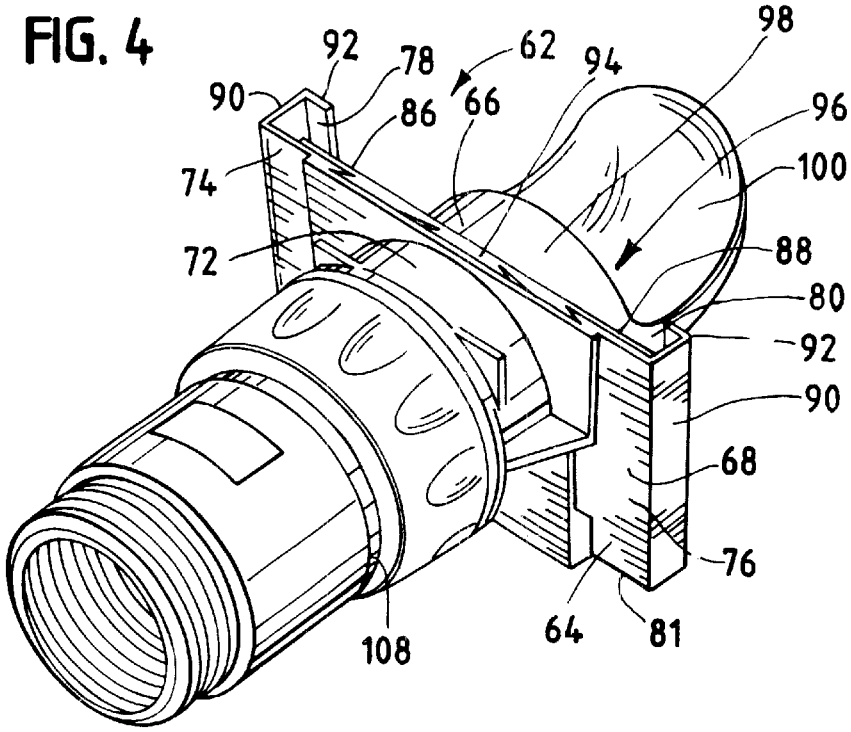
FIG. 4 is an isometric view of a vacuum bag fitting assembly constructed in accordance with the teachings of the invention.
Figure 5:
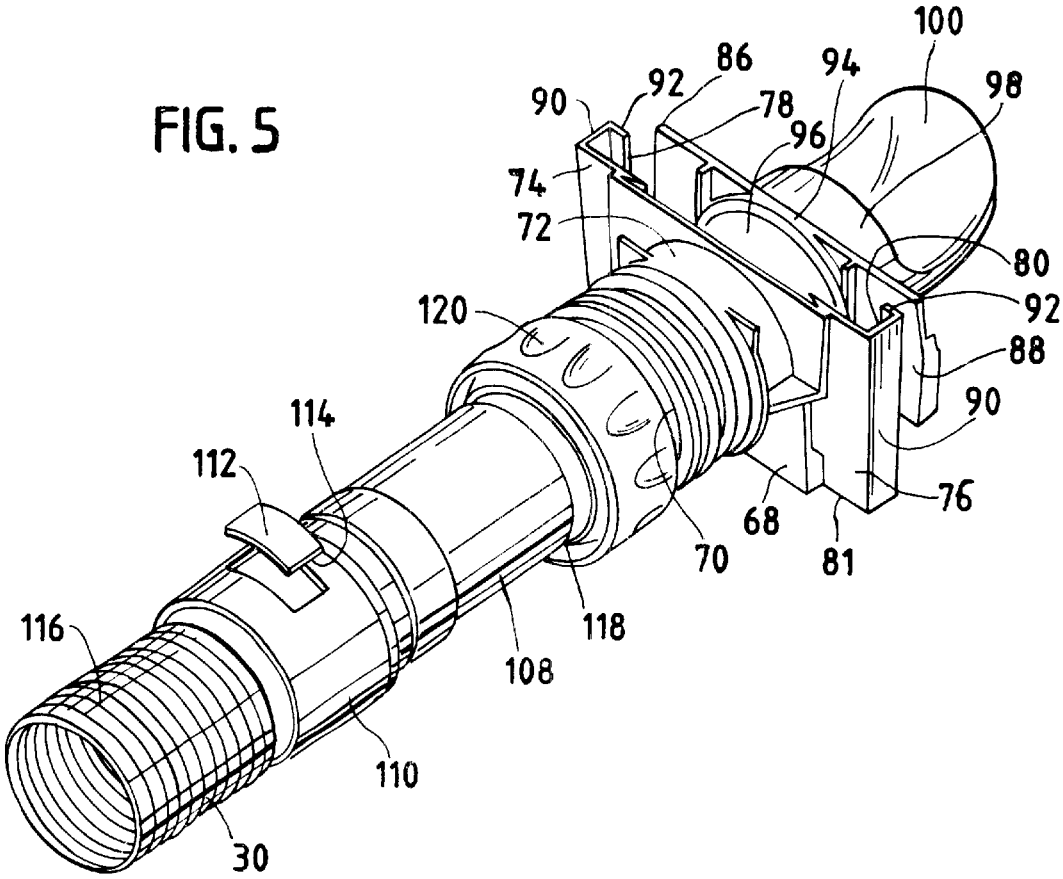
FIG. 5 is an exploded view of the fitting assembly of FIG. 4.

Alternatively, as shown in FIG. 3, the vacuum cleaner 20 can be used to vacuum wet materials in which case the bag 55 is not used and the wet debris gathered by the vacuum cleaner 20 is deposited directly within the tank 22, as will be described in further detail herein.

Referring now to FIGS. 4–7, the mechanism by which the vacuum bag 55 may be attached to the vacuum cleaner 20 is depicted. As shown therein, a vacuum bag fitting assembly 62 is provided. The fitting assembly 62 includes a vacuum bag retainer 64 to which a vacuum bag fitting 66 is slidably attached. The vacuum bag retainer 64 includes a plate 68 having an aperture 70 therein. A cylinder 72 circumscribes the aperture 70 and extends substantially orthogonally from the plate 68. The cylinder 72 extends through the inlet 28 in the side wall 24 for mounting the vacuum bag retainer 64 to the vacuum cleaner 20. First and second sides 74, 76 (FIG. 4) of the plate 68 include first and second mounting grooves 78 and 80 which terminate at a bottom shelf 81, and which receive sides of the collar 60 as well as sides 86, 88 of the vacuum bag fitting 66. Each mounting groove 78, 80 includes an extension 90 which extends orthogonally to the plate 68, as well as a lip 92 which extends substantially parallel to the plate 68.

Figure 7:
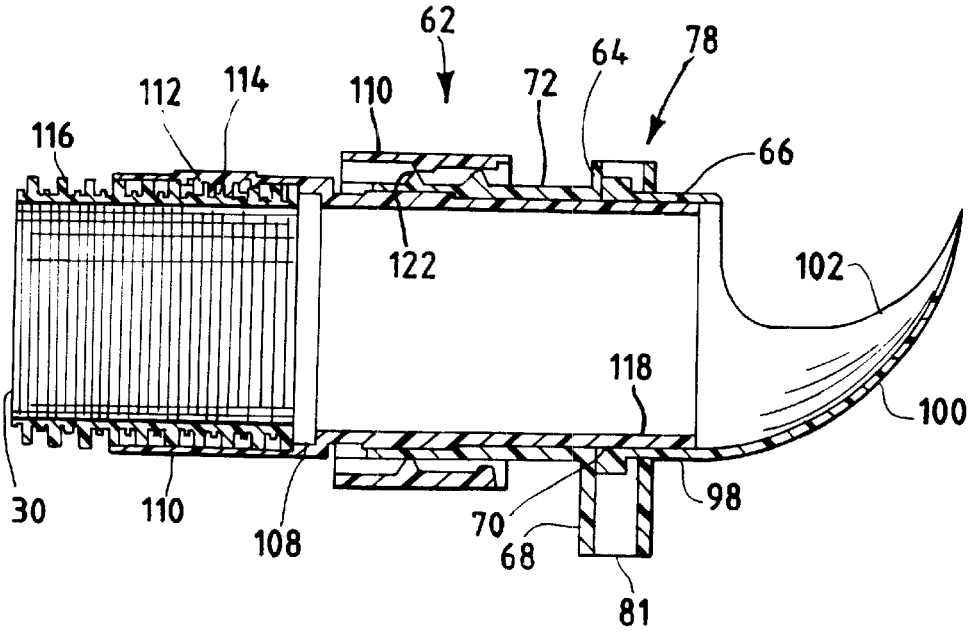
FIG. 7 is a sectional view of FIG. 4 with the deflector directed upwardly.

The vacuum bag fitting 66 includes a plate 94 having an aperture 96 therein. A cylinder 98 circumscribes the aperture 96 and extends substantially orthogonally to the plate 94. The cylinder 98 extends from the plate 94 in a substantially orthogonal direction before curving radially inwardly and terminating in a deflector 100. An outlet 102 is provided in a side wall of the cylinder 98 as shown in FIGS. 6 & 7. As a result of the curvilinear or angled shape of the deflector 100, a fluid stream directed in through the aperture 96 is deflected in the direction of the deflector 100 toward the outlet 102. Therefore, depending upon the position of the vacuum bag fitting 66, the direction of the exiting fluid stream will be affected.

More specifically, as depicted in FIG. 6, the deflector 100 may be directed downwardly such that the outlet 102 opens downwardly into the tank 22. Such a position for the vacuum bag fitting 66 would be appropriate when the vacuum cleaner 20 is used in conjunction with a vacuum bag 55 and when dry materials are being vacuumed. Conversely, as shown in FIG. 3, the deflector 100 may be positioned upwardly such that the outlet 102 opens upwardly within the tank 22 and proximate a downwardly depending shroud 106 of the lid 36. Such would be the position for the vacuum cleaner bag fitting 66 for vacuuming wet materials. In so doing, the liquid entering through the vacuum bag fitting 66 would be directed by the deflector 100 toward the shroud 106 and against which the liquid would be imparted to thereby slow the liquid before dropping into the tank 22. As a result, splashing of the liquid is lessened and the likelihood of splashing liquid being drawn into the motor/impeller unit and expelled through the blow outlet 32, or any other outlet provided within the vacuum cleaner 20, is abated.

In order to hold the vacuum bag fitting 66 and thus the vacuum bag 55 within the vacuum bag retainer 64, the vacuum hose 30 is used. More specifically, the hose 30 terminates in a coupling 108 which preferably includes a first end 110 sized to receive the vacuum hose 30. A clip 112 includes a plurality of downwardly depending teeth 114 which interfit with convolutions 116 of the hose 30 to frictionally attach the coupling 108 to the hose 30. The coupling 108 further includes a second end 118 which is sized to be telescopingly received within the cylinder 72 of the vacuum bag retainer 64. A nut 120 attached to the second end 118 interfits with threads 122 provided on the exterior of the cylinder 70 to the vacuum bag retainer 64 to temporarily and removably attach the coupling 108 to the vacuum bag retainer 64. The coupling 108 of the hose 30 enables the hose 32 to be attachable not only to the vacuum bag retainer 64 for vacuuming purposes, but also to the lower outlet 32 when the vacuum cleaner 20 is to be utilized for blowing purposes.

Figure 8:
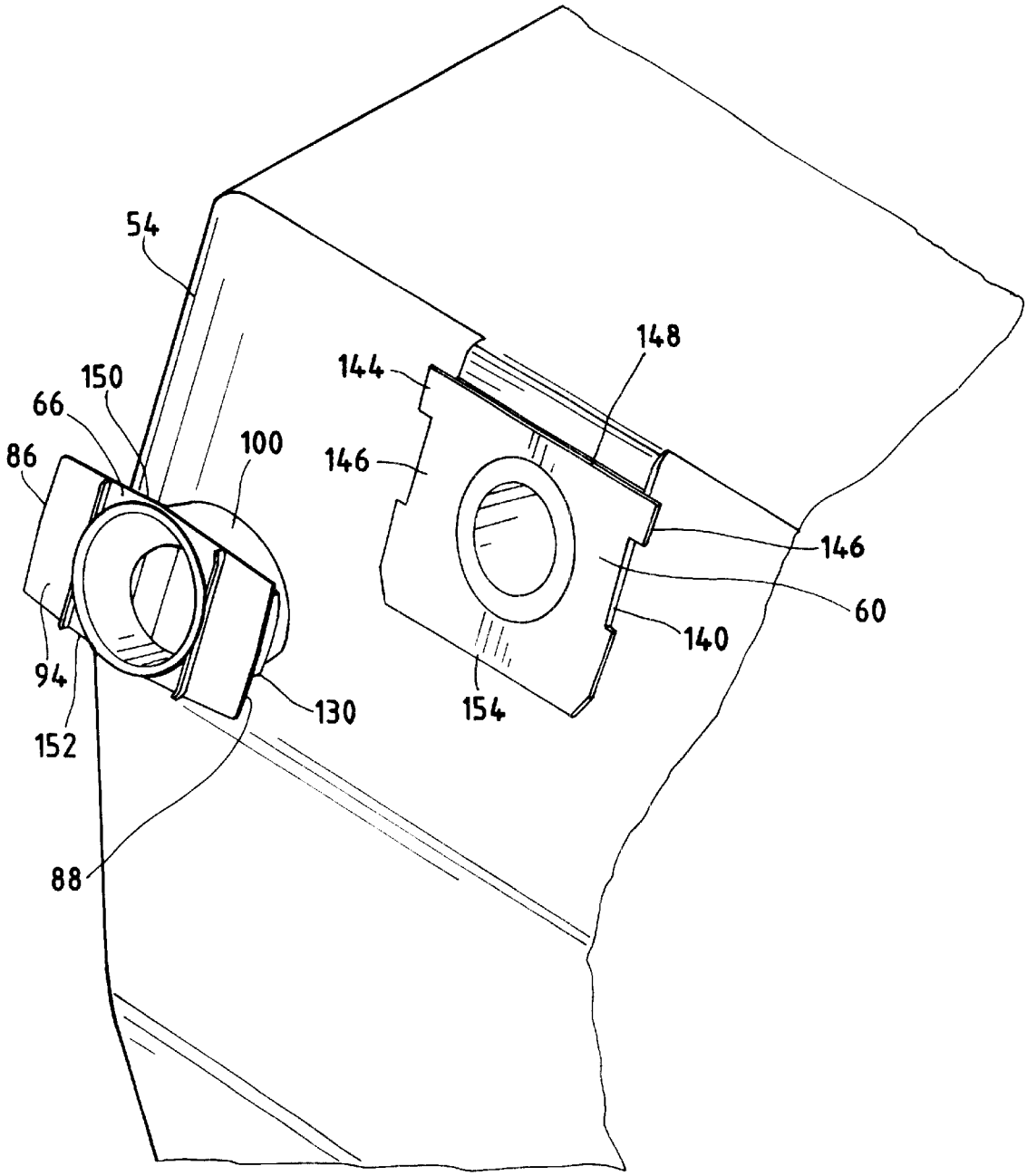
FIG. 8 is an exploded view of a vacuum bag fitting and vacuum bag having a one-way attachment feature according to the teachings of the invention.

The vacuum fitting 66 preferably also includes structure to ensure the deflector 100 is always inserted downwardly into the bag 55. As shown in FIG. 8, clips 130 orthogonally extend from sides 86, 88 respectively, of the vacuum bag fitting 66. Each clip 130, 132 may be substantially rectangular in shape and be dimensioned to frictionally interfit with recesses 140 of the collar 60 when the fitting 66 is attached to the vacuum bag 55. Each recess 140 is preferably positioned in sides 144, 146 of the collar 60 proximate a top edge 148. Similarly, the clips 130 are preferably positioned proximate a top edge 150 of the plate 94 so that the fitting 66 may only be attached to the bag 55 in one position with that position ensuring the deflector 100 is pointed downwardly. In alternative embodiments, clips 130 or other mechanisms, and recesses 140 may be differently positioned such as toward a bottom edge 152 of the plate 94 and a bottom edge 154 of the collar 60 to ensure one-way attachment.

In operation, it can therefore be seen that a vacuum bag 55 may be attached to the vacuum cleaner 20 using the fitting assembly 62. The vacuum bag fitting 66 is first attached to the vacuum bag 55 by inserting the deflector 100 into the aperture 58 of the vacuum bag 55 such that the plate 94 of the vacuum bag fitting 66 is adjacent the collar 60. The collar 60 and plate 94 are then slid between the mounting grooves 78, 80 of a vacuum bag retainer 64 until the collar 60 and plate 94 engage a bottom shelf 81 of the vacuum bag retainer 64. The mounting grooves 78, 80 prevent lateral movement of the collar 60 and plate 94, while the bottom shelf 81 prevents downward movement of the collar 60 and plate 94. In order to prevent upward movement of the collar 60 and plate 94, the coupling 108 is then inserted through the vacuum bag retainer 64 aperture 70, as well as the aperture 96 of the vacuum bag fitting 66 and the aperture 58 of the vacuum bag 55, as shown best in FIG. 6. The coupling 108 is then secured to the vacuum bag retainer 64 by rotation of the nut 120 and thus interaction between the nut 120 and the threads 122. As also shown in FIG. 6, the collar 60 is secured against movement in, as shown best in FIG. 6. The coupling 108 is then secured to the vacuum bag retainer 64 by rotation of the nut 120 and thus interaction between the nut 120 and the threads 122. As also shown in FIG. 6, the collar 60 is secured against movement in the direction of longitudinal axis A in that it is positioned between the plate 94 of the vacuum bag fitting 66, and the lips 92 of the vacuum bag retainer 64.

When the bag 55 is to be removed, such as when the vacuum cleaner 20 is to be used to suction wet materials, the vacuum hose 30 is removed by appropriate rotation of the nut 120 and pulling of the coupling 108 from the vacuum bag retainer 64. The collar 60 and plate 94 of the vacuum bag fitting 66 and then slid from the mounting grooves 78, 80 of the vacuum bag retainer 64. The vacuum bag fitting 66 is then removed from the vacuum bag 55 with the vacuum bag 55 being discarded. The vacuum bag fitting 66 is then rotated 1800 and again slid into the mounting grooves 78, 80 of the vacuum bag retainer 64. In so doing, the deflector 100, as well as the outlet 102, are pointed upwardly such that when the lid 36 is attached to the tank 22, the outlet 102 opens in the general direction of the shroud 106. The vacuum bag fitting 66 and thus deflector 100 are then secured in position by the mounting grooves 78, 80, bottom shelf 81, and coupling 108 as previously described.

From the foregoing, it will be appreciated that the invention provides a fitting for a vacuum cleaner which is adapted to deflect the incoming fluid stream in an upward or downward direction. Depending upon the type of material being vacuumed, the vacuum bag fitting may be used to mount a vacuum bag collar to the vacuum cleaner.

What is claimed is:

1. A vacuum cleaner, comprising:

a tank having a side wall, closed bottom wall and open top, an inlet being provided in the tank side wall;

a lid removably attached to the tank open top;

a motor/impeller unit mounted within the lid;

a vacuum bag retainer mounted to the tank side wall, an inlet of the vacuum bag retainer extending through the tank side wall inlet;

a vacuum bag fitting connected to the vacuum bag retainer, the vacuum bag fitting including a deflector;

a vacuum bag attached to the vacuum bag fitting; and a vacuum hose extending through the tank inlet, vacuum bag retainer, vacuum bag fitting, and vacuum bag.

2. The vacuum cleaner of claim 1, wherein the vacuum bag retainer includes first and second opposed slots and the vacuum bag fitting slidably connects to the vacuum bag retainer.

3. The vacuum cleaner of claim 2, wherein the vacuum bag fitting includes a plate adapted to slide within the first and second opposed slots, the plate including an aperture, a cylinder extending from the plate proximate the plate aperture and terminating in the deflector.

4. The vacuum cleaner of claim 3, wherein the cylinder includes an inlet proximate the plate aperture and an outlet in a side wall of the vacuum bag fitting cylinder.

5. The vacuum cleaner of claim 4, wherein the vacuum bag fitting is insertable in the vacuum bag retainer into at least two positions, the cylinder outlet opening upward in a first position, the cylinder outlet opening downward in a second position.

6. The vacuum cleaner of claim 5, wherein the lid further includes a shroud depending therefrom, the cylinder outlet opening proximate the shroud when the vacuum bag fitting is in the first position.

7.

8. The vacuum cleaner of claim 7, wherein the collar is held between the vacuum bag retainer and the vacuum bag fitting plate.

9. The vacuum cleaner of claim 1, wherein the vacuum hose is attachable to the vacuum cleaner inlet and a blower outlet of the vacuum cleaner.

10. The vacuum cleaner of claim 9, wherein the vacuum cleaner hose includes a threaded nut adapted to attach to the vacuum bag retainer.

11. The vacuum cleaner of claim 1, wherein the vacuum bag retainer, vacuum bag fitting and vacuum hose are manufactured from plastic.

12. The vacuum cleaner of claim 7 wherein the vacuum bag fitting and vacuum bag include a one-way attachment mechanism to ensure the deflector extends downwardly in the bag.

13. The vacuum cleaner of claim 12 wherein the one-way attachment mechanism includes at least one clip extending from the vacuum bag fitting and at least one recess, the clip being adapted to matingly attach to the recess to ensure the deflector is positioned downwardly in the bag.

14. A vacuum bag fitting, comprising:

a plate having an aperture therein;

a cylinder having an inlet and an outlet, the cylinder extending from the plate, the cylinder inlet being concentric with the plate aperture, a longitudinal axis passing through the cylinder; and a deflector extending from the cylinder proximate the cylinder outlet, the deflector extending toward the longitudinal axis, the deflector extending in a first direction when vacuuming wet debris, the deflector extending in a second, different, direction when vacuuming dry debris.

15. The vacuum bag fitting of claim 14, wherein the deflector extends across substantially all of the cylinder, and the cylinder outlet is provided in a side wall of the cylinder.

16. The vacuum bag fitting of claim 14, wherein the vacuum bag fitting is removable with multiple vacuum bags.

17. The vacuum bag fitting of claim 14, wherein the vacuum bag fitting is manufactured from plastic.

18. The vacuum bag fitting of claim 14 further including first and second clips extending from the plate, the first and second clips adapted to ensure attachment to a vacuum bag in only one position.

19. A vacuum bag fitting assembly, comprising:

a vacuum bag retainer having a backplate and first and second slots, an aperture being provided in the backplate with the first and second slots laterally flanking the aperture; and a vacuum bag fitting adapted to connect to a vacuum bag and removably attach to the vacuum bag retainer, the vacuum bag fitting including a plate having an aperture therein and a cylinder extending away from the plate and circumscribing the aperture, the cylinder terminating in a radially inwardly directed deflector, the plate adapted to slide within the first and second slots of the vacuum bag retainer, the deflector extending in a first direction when vacuuming wet debris, and in a second, different, direction when vacuuming dry debris.

20. The vacuum bag fitting assembly of claim 19, wherein the vacuum bag fitting cylinder includes an inlet and an outlet, the inlet being provided proximate the plate aperture, the outlet being provided in a side wall of the cylinder.

21. The vacuum bag fitting assembly of claim 19 wherein the vacuum bag fitting includes at least one clip adapted to connect to a vacuum bag in only one position.

22. A method of attaching a vacuum bag to a vacuum cleaner, comprising the steps of:

inserting a vacuum bag fitting into a vacuum bag, the vacuum bag fitting including a plate from which a deflector extends, the deflector extending in a first direction when vacuuming wet debris and in a second, different, direction when vacuuming dry debris;

attaching the vacuum bag fitting to a vacuum bag retainer provided within a tank of the vacuum cleaner, inlets of the vacuum bag, vacuum bag fitting and vacuum bag retainer being aligned; and pushing a vacuum hose through the inlets of the vacuum bag, vacuum fitting and vacuum bag retainer.

23. The method of claim 22, wherein the attaching step involves sliding sides of the vacuum bag fitting into slots of the vacuum bag retainer.

24. The method of claim 22, further including the step of securing the vacuum hose after the pushing step.

25. The method of claim 24, wherein the securing step is performed using a threaded nut provided on the hose and mating threads provided on the vacuum bag retainer.

26. The method of claims 22, wherein the inserting step includes the step of fitting a clip extending from the vacuum bag fitting into a recess provided on a collar of the bag.

27. In a vacuum cleaner of the type having a tank, a lid, a motor/impeller mounted in the lid, an inlet to the tank, and a hose adapted to be used for vacuuming and blowing; the improvement comprising:

a bag mounting structure mounted within the tank proximate the inlet; and a deflector adapted to direct an incoming fluid stream into one of a bag and the tank, the deflector being mounted in the bag mounting structure in a downward direction when the fluid stream is dry, the deflector being mounted in the bag mounting structure in an upward direction when the fluid stream is wet.

* * * * *

UNITED STATES PATENT AND TRADEMARK OFFICE

CERTIFICATE OF CORRECTION

PATENT NO. : 6,451,078 B2 
DATED : September 17, 2002
INVENTOR(S) : Robert C. Berfield and Robert L. Crevling It is certified that error appears in the above-identified patent and that said Letters Patent is hereby corrected as shown below:

Column 6,
Line 46, after numeral "7" please insert, -- The vacuum cleaner of claim 3, wherein the vacuum bag includes a collar adjacent an inlet of the vacuum bag. --

Signed and Sealed this

Eighteenth Day of February, 2003

JAMES E. ROGAN
*Director of the United States Patent and Trademark Office*